US006615446B2

(12) United States Patent
Noreen et al.

(10) Patent No.: US 6,615,446 B2
(45) Date of Patent: Sep. 9, 2003

(54) CANISTER VACUUM CLEANER

(76) Inventors: Mary Ellen Noreen, 7960 DeMontreville Trl. N., Lake Elmo, MN (US) 55042; Allen Leonard Noreen, 7960 DeMontreville Trl. N., Lake Elmo, MN (US) 55042

( * ) Notice: Subject to any disclaimer, the term of this patent is extended or adjusted under 35 U.S.C. 154(b) by 0 days.

(21) Appl. No.: 10/002,829

(22) Filed: Nov. 30, 2001

(65) Prior Publication Data

US 2003/0101534 A1 Jun. 5, 2003

(51) Int. Cl.[7] ..... A47L 9/32
(52) U.S. Cl. ..... 15/410; 15/327.2; 15/353
(58) Field of Search ..... 15/327.1, 327.2, 15/327.6, 327.7, 410, 353

(56) References Cited

U.S. PATENT DOCUMENTS

| | | | | | |
|---|---|---|---|---|---|
| 2,819,485 | A | | 1/1958 | Sparklin | |
| 3,023,838 | A | | 3/1962 | Gaudry | |
| RE32,751 | E | * | 9/1988 | Joss et al. | 15/329 |
| 4,967,862 | A | | 11/1990 | Pong et al. | |
| 5,267,371 | A | | 12/1993 | Soler et al. | |
| 5,608,945 | A | * | 3/1997 | Crouser et al. | 15/328 |
| 5,867,862 | A | * | 2/1999 | Ahlf et al. | 15/329 |
| 6,145,160 | A | * | 11/2000 | Buss et al. | 15/323 |
| 6,154,921 | A | | 12/2000 | Green et al. | |
| D446,612 | S | | 8/2001 | Kohler | |

FOREIGN PATENT DOCUMENTS

| | | | |
|---|---|---|---|
| EP | 1021981 | * | 7/2000 |
| JP | 3-222928 | * | 10/1991 |
| JP | 6-154140 | * | 6/1994 |
| JP | 11-299715 | * | 11/1999 |

* cited by examiner

*Primary Examiner*—Terrence R. Till

(57) ABSTRACT

A canister type vacuum cleaning appliance with a collapsible handle, attached to the housing, that is adjustable to the height of the user and positioned such that the user can use the handle to move and guide the housing unit with one hand while moving about a room, or between rooms, while manipulating the hose assembly with the other hand.

28 Claims, 3 Drawing Sheets

CANISTER VACUUM CLEANER

CROSS-REFERENCE TO RELATED APPLICATIONS

NOT APPLICABLE

STATEMENT REGARDING FEDERALLY SPONSORED RESEARCH

NOT APPLICABLE

REFERENCE TO A MICROFICHE APPENDIX

NOT APPLICABLE

BACKGROUND OF THE INVENTION

Canister vacuum cleaners comprise a rigid outer container, the housing unit, that contains the motor, air impeller, and a dust and dirt filter and collector and reservoir, often in the form of a disposable filter bag. The shape of the outer containers is either substantially rectangular or cylindrical, and has a hose assembly that attaches both to the housing unit and to a cleaning wand and/or power head. The housing unit usually has fixed shaft or swivel caster type wheels for ease of movement, and may be horizontally and/or vertically oriented as defined by the longer axis of the housing unit. The housing unit has an air entry port to which the hose assembly is mounted. In operation, the dirty air passes through the hose into the housing unit and then is filtered prior to exiting the machine. Some canister vacuum cleaners include wet or dry collection options.

When the vacuum is horizontally oriented, the hose is mounted at one end of the housing unit. A dirt filter and collector, such as a filter bag, is positioned adjacent to that end of the container and a motor is positioned behind it. In operation the air carrying dust and dirt passes through the hose into the dirt filter and collector and the filtered air passes by the motor before exiting the vacuum cleaner. Alternatively, when the vacuum cleaner is of the type with a vertical orientation of the housing unit, the motor is typically mounted on top of the housing unit and may extend into the housing. For vertically oriented canister vacuum cleaners the dirt reservoir may or may not be a filter bag. Sometimes the bottom portion of the housing unit acts as the dirt reservoir. More recent designs include housing units that can be operated in either the vertical or horizontal position.

Canister vacuum cleaners have a cleaning head attached to the end of the hose assembly distal to the entry port on the housing unit. The design results in a cleaning head, which is generally smaller, has better flexibility, and is more maneuverable for reaching lower and farther than an upright cleaner. However, canister vacuum cleaners suffer from a significant disadvantage. Typically when one is using a canister vacuum cleaner, for example to clean the flooring of the various rooms in a home, the hose is generally used to guide the movement of the canister or housing unit portion. This generally involves basically dragging the canister vacuum cleaner around the rooms, and between the rooms, by the hose. While pulling on the hose, the canister frequently bumps into impediments, for example corners of walls and furniture, and sometimes becomes wedged on such obstacles. When this happens, the operator must stop and walk back to the housing unit to free it of such obstructions before proceeding with the task of cleaning the floors. This can happen numerous times during a typical vacuuming job. Sometimes when the canister becomes stuck on such obstacles the hose can become disconnected. If the canister is vertically oriented with a high center of gravity it can tip over when encountering a low-lying obstacle. When the canister is being pulled by the hose, and it runs into a piece of furniture or the corner of a wall, an additional untoward result can be blemishes caused on the walls or furniture. An additional problem associated with the canister encountering such obstacles is that a normal tendency is to tug on the hose to see if the canister can be pulled free without the operator needing to walk back to the canister. The result of this can be premature wearing of the hose and the fitting where the hose is fitted to the canister. These problems not only occur when the vacuum cleaner is being used to clean a floor or other surface but also when one is transporting the vacuum cleaner from room to room or from its storage location to the area it is to be used. These problems are irritating, time consuming, and tiring.

Several attempts have been made to minimize these guiding and transport problems. One such attempt is taught in U.S. Pat. No. 4,967,862, which utilizes a robotic style mechanism which senses the angle of the obstruction contacted, stops the canister and backs it up and then turns far enough away from the obstacle to go around if safely. This solution, although eloquent, would add significantly to the cost and weight of a canister vacuum cleaner.

Another approach, taught in U.S. Pat. No. 5,267,371 is to put the canister into a backpack. While this approach certainly solves the problems of the housing unit running into and getting caught on obstacles it requires much more strength and dexterity of the user and it would be very inconvenient and uncomfortable for many users.

U.S. Pat. No. 6,154,921 discloses a canister vacuum cleaner with a pivotal and locking handle about an axis that is substantially horizontal and perpendicular to the movement of the vacuum when it is in the working (horizontal) position. The main purpose of the handle is to provide easier lifting and carrying the canister housing, but does not appear to address the problems associated with the housing unit running into obstructions during use, unless the user actually carries the housing unit using this handle while using the vacuum cleaner. Carrying the full weight of the housing unit would be very tiring and inconvenient for the user. Thus there continues to be a need for an alternate solution to the problems associated with the guidance and transport of the housing unit portion of canister vacuum cleaner during use.

BRIEF SUMMARY OF THE INVENTION

The object of this invention is to provide a solution to the problems, mentioned above, associated with the guiding and transporting of a canister type vacuum cleaner during use.

We have found that the addition of a handle, attached to the housing, that is adjustable to the height of the user and positioned such that the user can use the handle to move and guide the housing unit with one hand while moving about a room, or between rooms, while manipulating the hose assembly with the other hand creates a method of use that overcomes the aforementioned problems in a way that is comfortable and convenient for the user while not requiring the user to carry the full weight of the housing unit while using the vacuum cleaner.

Additionally, the addition of the handle, positioned on the housing so that the operator can use the handle to direct the movement of the canister with one hand while the other hand manipulates and guides the hose and power head, solves the problem of tipping that is present with vertically oriented canisters. The handle of the canister vacuum cleaner of this invention is preferably collapsible. A collapsible handle is one that has an extended use position, that positions the hand grip at a convenient height for use in guiding or transporting the housing using the wheels, and that has a storage position that takes the handle out of the way for easier storage by either telescoping or folding in a hinged manner to position the handle out of the way for storage. This allows the handle to be extended to a convenient height for individual users, for using the vacuum cleaner, and allows the handle to be collapsed into a storage position.

There are several known types of handles that can be used to achieve the canister vacuum cleaner of this invention. One preferred type of handle is a hinged handle, wherein it is hinged at the point where it is mounted to the housing unit. This hinged type handle has an extended, or folded up position, that places the handgrip at a convenient height for the user, and a collapsed, or folded down, position wherein the handle lies adjacent the housing to minimize the storage space needed for the canister vacuum.

Another preferred type of handle is a telescoping handle. Such a telescoping handle can be adjusted for height to place a handgrip at the distal end of the handle at a convenient height for individual users. It can also be telescoped into its base to position the handle out of the way for convenient storage of the canister vacuum cleaner. Yet another preferred type of handle is one that is telescoping and hinged so that when the handle is in the extended configuration it can be either extended along the main axis of the housing unit or positioned at an angle to place the handgrip at a convenient height for the user without requiring the user to lift any portion of the housing unit while using the vacuum cleaner. Both the hinged and telescoping handles can be either single or double shaft type handles.

It was also found that the addition of a handle, adjusted to the height of the user, combined with appropriately placed canister wheels or simple slide rails, provides an excellent transport system for moving the vacuum longer distances, for example from one part of a house to another. With this type of handle arrangement, the handle is positioned such that it can be used with one hand to pull the housing unit along, while the other hand carries the hose assembly. It is not necessary to lift and carry the housing unit for moving it from one location to another.

The back top of the housing unit of horizontally oriented canister vacuum cleaners of this invention can also include a built in stabilizing bar enabling it to stand upright when the operator is not holding the handle while operating the machine.

The location of the wheels will depend whether the housing unit of the vacuum is horizontally oriented or vertically with the former using wheels in the front and back. For horizontally oriented housing units the front wheels are defined as those at the end of the housing unit where the flexible hose assembly attaches to the housing unit, and the back wheels are those at the end of the housing unit opposite that end where the hose assembly attaches. The front wheels may beneficially be of the pivoting type. Alternatively the wheels may be one swivel in the front and two placed inside the plane of the back face such that the housing may be positioned horizontally or vertically. A permanently disposed vertical canister would have the wheels on the bottom of the housing unit. The handle and wheels may be totally integrated into the canister housing or alternatively a separate framework could be used.

DETAILED DESCRIPTION OF THE INVENTION

It should be noted that in the following detailed description identical components have the same reference numbers in drawings and in the various embodiments of the invention described.

Figure 1:
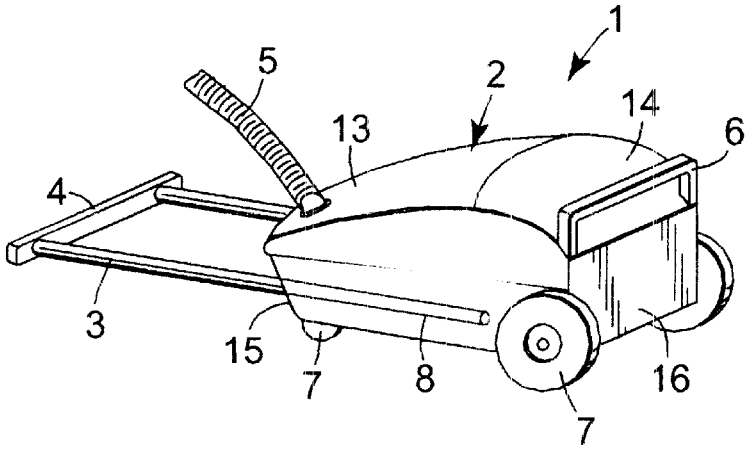
FIG. 1 shows a horizontally oriented canister type vacuum cleaning appliance, in accordance with the invention, in side view, showing a telescoping handle in the extended position.

Referring to FIG. 1, there is shown a canister vacuum cleaner 1 having a horizontally oriented housing unit 2, a telescoping handle 3 shown in the extended position, a handgrip 4 at the distal end of handle 3, a portion of a hose assembly 5 attached to the housing unit 2 at the front end portion 13, a rear mounted stabilizing bar 6 mounted on the back end portion 14 of the housing unit 2, transport wheels 7 and the handle guiding and storage channel 8 to contain the telescoping handle 3 when in the collapsed position. In horizontally oriented housing units there is a front end portion 13 and a back end portion 14. The front end portion 13 refers to that end of the horizontally oriented housing unit where the flexible hose assembly 5 attaches to the housing unit. The front end portion 13, as defined herein, includes not only the front face 15 of the housing unit but the area of the housing unit adjacent the front face. Similarly the back end portion 14 refers not only to the back face 16 of the housing unit but also the area of the housing unit adjacent the back face 16. The front face 15 refers to the surface of the housing unit 2 that is generally facing forward and similarly the back face 16 is that surface that is generally facing back, with the hose 5 attachment end defining front. The handle 3 has proximal and distal ends. The proximal end is defined as the end where a handgrip 4 is attached and the distal end is defined as the end that attaches to the housing unit 2.

The hose assembly 5, sometimes referred to as the flexible hose assembly consists of a flexible hose, a means for attaching to the housing unit 2, and optionally a non-flexible hose portion that is used to attach various cleaning tools and the power head 9.

The handle 2 can be either a single shaft or a double shaft type. The shaft, or shafts, of the handle refer to that portion of the handle that extends between the point where the handle attaches to the housing unit 2 and the handgrip 4. Double shafted handles are preferred for the extra strength and stability they provide. The handgrip 4 is the proximal end of the handle, adapted for comfortable grasping by the hand of a person using the vacuum cleaner 1.

When the handle 3 is a double shaft type the handgrip 4 will typically bridge and connect the two shafts at their proximal ends. The handgrip 4 may be contoured to be more comfortable in the hand of a user and may be covered with a soft or rubbery material to enhance hand comfort.

Figure 2:
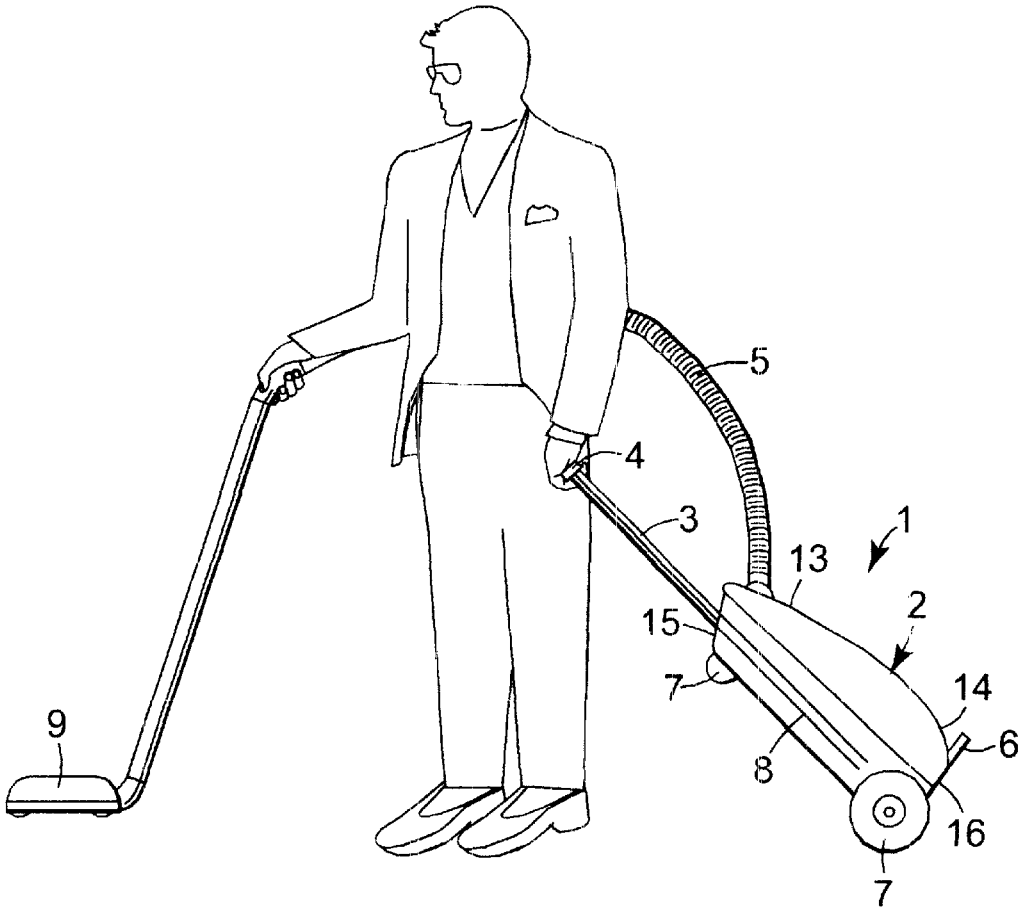
FIG. 2 shows a horizontally oriented canister type vacuum cleaning appliance, in accordance with the invention, in the use position.

Referring to FIG. 2, there is shown the canister vacuum cleaner 1 having a horizontally oriented housing unit 2 of FIG. 1 being held by a user with one hand grasping the hand grip 4 of handle 3 which allows the user to easily direct the movement of the housing unit 2 while the user's other hand holds and directs the hose assembly 5 and attached power head 9. In the iteration of the invention depicted in FIGS. 1 and 2, when the user is using the vacuum cleaner, the bulk of the weight of the housing unit 2 is carried by the wheels 7, proximate the back face 16 of the housing unit, yet the user has excellent one handed control of the movement of the housing unit 2 while easily able to direct and manipulate the power head 9 by using the other hand on the hose assembly 5. For convenience of letting go of the handle 3 momentarily while using the vacuum cleaning appliance of this invention, as illustrated in FIGS. 1 and 2, a rear stabilizing bar 6 may be added to the housing unit proximate the back face 16. This allows the user to leave the housing unit in a stable stationary vertical orientation when the use of the vacuum cleaner is interrupted and then conveniently grasp the handle 3, without needing to bend over to grasp the handle, when resuming use of the vacuum cleaner. In situations where the users desires to use both hands on the flexible hose assembly 5, or where one hand is required to move items, for example, pillows, while the other hand directs the flexible hose, the horizontal housing unit 2 can be moved by pulling flexible hose assembly.

Continuing to refer to FIG. 2 it is shown that when the handle 3 is in the extended position, and the user is holding the handgrip 4 to control and guide the movement of the housing unit 2, the user is free to walk normally as the front end portion 13 of the housing unit 2 is elevated and the closeness of the housing unit 2 to the user is easily controlled by simple arm movements. Additionally as the user uses the handle 3 to pull the housing unit 2 along, it will generally be positioned behind them, thus not restricting their walking motions when transporting the vacuum cleaner 1, for example, from room to room.

Horizontally oriented housing units 2 have a main axis, which is defined as the axis extending through the front 15 and back 16 faces of the housing unit 2 and generally parallel to the other surfaces of the housing unit. Support surface, herein, refers to the surface the housing unit 2 is on, such as a carpet or floor. When a person is using the handle 3, as shown in FIG. 2, to lift the front end portion 13 of the housing unit 2 an angle is created between the plane of the support surface and the main axis of the housing unit 2. This angle is between about 30 and about 80 degrees, and is preferably between about 40 and 65 degrees. When this angle is in this range the bulk of the weight of the housing unit 2 is carried on the wheels 7 proximate the back face 16 of the housing unit and, the front end portion 13 of the housing unit 2 is held out of the way enough to not impede a normal walking motion. For horizontal housing units of this type the front wheels may be omitted or may be replaced with stationary supports or skids. When the vacuum 1 is being used in this manner, FIG. 2, the height of the handgrip 4 will be between about 20 and 36 inches above the support surface. This height depends upon the height of the user, the degree of extension of the handle 3, and the length of the housing unit 2. This height range will normally be achieved by most users when holding the handgrip with the angle between the main axis of the housing unit and the support surface being between about 30 and 80 degrees. The telescoping handle of FIGS. 1 and 2 extends beyond the front face 15 of the housing unit 2, in the direction of the main axis of the housing unit, by at least about 12 inches when in the extended use position, and preferably at least 18 inches.

Figure 3:
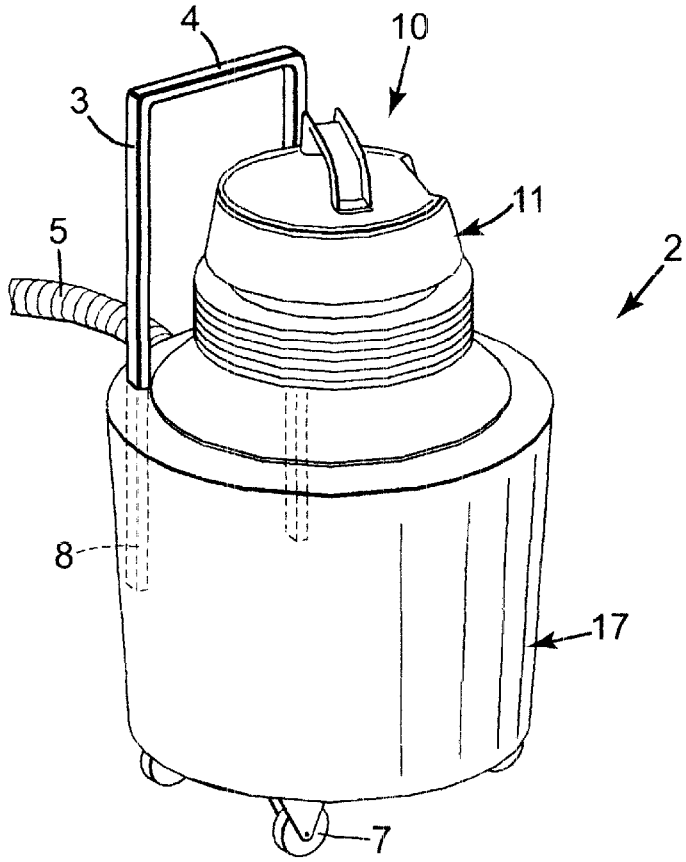
FIG. 3 shows a vertically oriented canister vacuum cleaning appliance, in accordance with the invention, with a telescoping handle in the extended use position.

FIG. 3 shows a canister vacuum cleaner 10 with a vertically oriented housing unit 2 in accordance with the invention. Generally in a conventional vertically oriented canister the motor is housed in a removable top portion of the housing unit. For vertically oriented housing units there are top 11 and bottom 17 portions of the housing unit. The top portion 11 contains the motor and is removably attached to the bottom portion 17. The bottom portion 17 acts as the dirt reservoir. This results in the typical vertically oriented canister vacuum cleaner being top heavy and therefore easily tipped when the wheels encounter an obstruction as the vacuum cleaner is being moved. Although the vertically oriented canister vacuum cleaner 10, shown in FIG. 3, of the invention has the motor in the top removable portion 11 of the housing unit 2 the use of the collapsible handle 3 in the extended position, to guide and move the housing unit 2 while using the vacuum cleaner 10 overcomes this problem of the housing unit 2 tipping.

Figure 5:
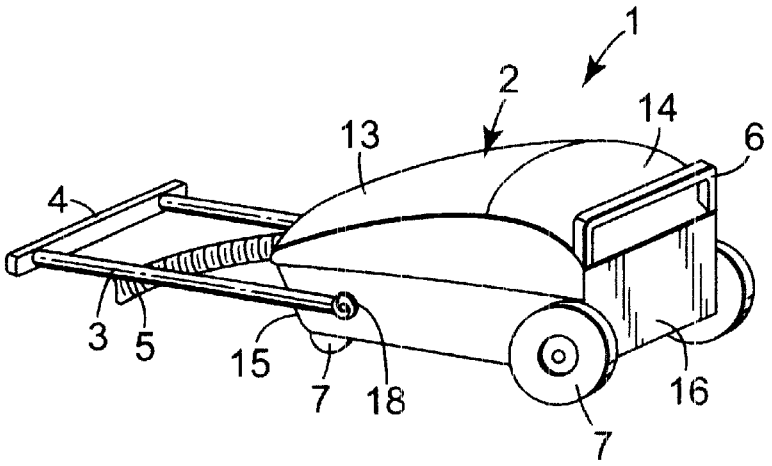
FIG. 5 shows a horizontally oriented canister type vacuum cleaning appliance, in accordance with the invention, in side view, showing a hinged handle in the extended position.

FIG. 3 shows the placement of the handle 3 on the same side of the housing unit 2 as where the hose assembly 5 enters the housing unit 2. The handle 3, in FIG. 3, is shown in the extended position placing the handgrip 4 at a convenient height for the user to hold while using the vacuum cleaner 10. The movement of the vacuum cleaner 10 is facilitated by wheels 7. Also shown in FIG. 3 is the handle guiding and storage channel 8 that would house the handle 3 when in the collapsed storage position. The vertically oriented canister vacuum 10 depicted in FIG. 3 shows the handle 3 mounted on the same side of the housing unit 2 as the port where the hose assembly 5 attaches to housing unit 2, specifically the hose assembly 5 is shown attaching to the lower portion 17 of housing unit 2, on the same side as handle 3. In another iteration of this invention the vertically oriented canister has the hose assembly 5 attaching to the housing unit 2 at the top portion 11 of the housing unit 2, specifically that portion 11 of the housing unit 2 that contains the motor, as shown in FIG. 5. FIG. 5 also shows the flexible hose assembly 5 attaching to the too portion 11 of the housing unit, at a distance no more than half the diameter of the generally cylindrical housing unit when viewed from above, from where the handle 3 attaches to the bottom portion 17 of the housing unit 2.

For vertically oriented housing units of the type shown in FIG. 3 the housing unit 2 may be conveniently guided and transported with all of the wheels 7 in contact with the support surface or with only those wheels that are adjacent to where the handle attaches to the housing unit 2. In the later case the housing unit is tilted, similarly to what is shown in FIG. 2 for a horizontally oriented housing unit, as the housing unit is guided and transported using the handle 3. In such cases the weight will be carried by the wheels proximate the handle 3 attachment and the housing unit will form an angle with the support surface of between about 30 degrees and about 80 degrees.

Figure 4:
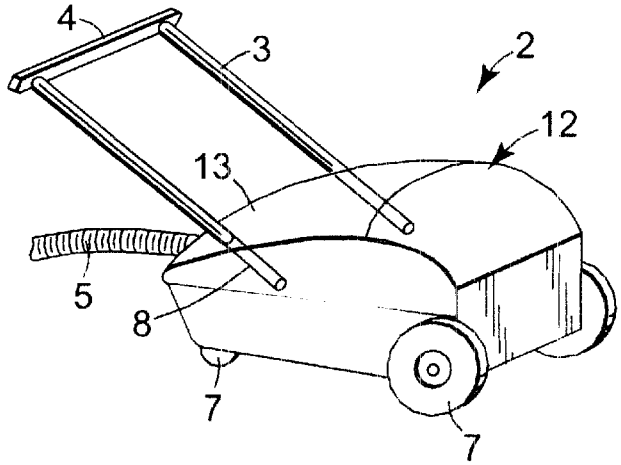
FIG. 4 shows another iteration of a horizontally oriented canister vacuum cleaning appliance, in accordance with the invention, with a telescoping handle in the extended use position.

FIG. 4 shows a horizontally oriented canister vacuum cleaner 12 of this invention with the handle 3 mounted on the housing unit 2 such that when it is in its extended position the handgrip 4 is positioned at a convenient height for a user to hold to guide the housing unit 2 while using the vacuum cleaner 12 without the user needing to lift the front end portion 13 of the housing unit 2, defined as the end of the housing unit where the hose assembly 5 attaches to the housing unit 2, to move the vacuum cleaner 12 about during use. Also shown in FIG. 4 are the wheels 7 and the handle guiding and storage channel 8 where the handle 3 would be when in the collapsed storage position. In this embodiment of the invention, FIG. 4, the handle 3 is mounted to the housing unit in such a way that when it is extended it creates an angle with the main axis of the housing unit 2. This angle is between about 30 and 80 degrees. In this embodiment, when the handle 3 is extended into its use position it positions the handgrip 4 at a height of between about 20 and 36 inches above the support surface and the handgrip 4 will be forward of the front face 15 of the housing unit 2. This allows a person using the vacuum of this embodiment to comfortably grasp the handgrip 4 to guide the movement of the housing unit 2 without lifting the front end portion 13 of the housing unit 2. In embodiments of the invention as illustrated in FIG. 4 the wheels 7 that are proximate the front face 15 may beneficially be of the pivoting type.

Canister type vacuum cleaner housing units have exterior and interior surfaces. For telescoping type handles the shaft telescopes out of, to the extended position, and into, for the collapsed storage position, at least one handle guiding and storage channel 8. This channel, one per shaft, acts as guiding means for the handle 3 and the handle is in slidable contact with this channel 8.

Figure 6:
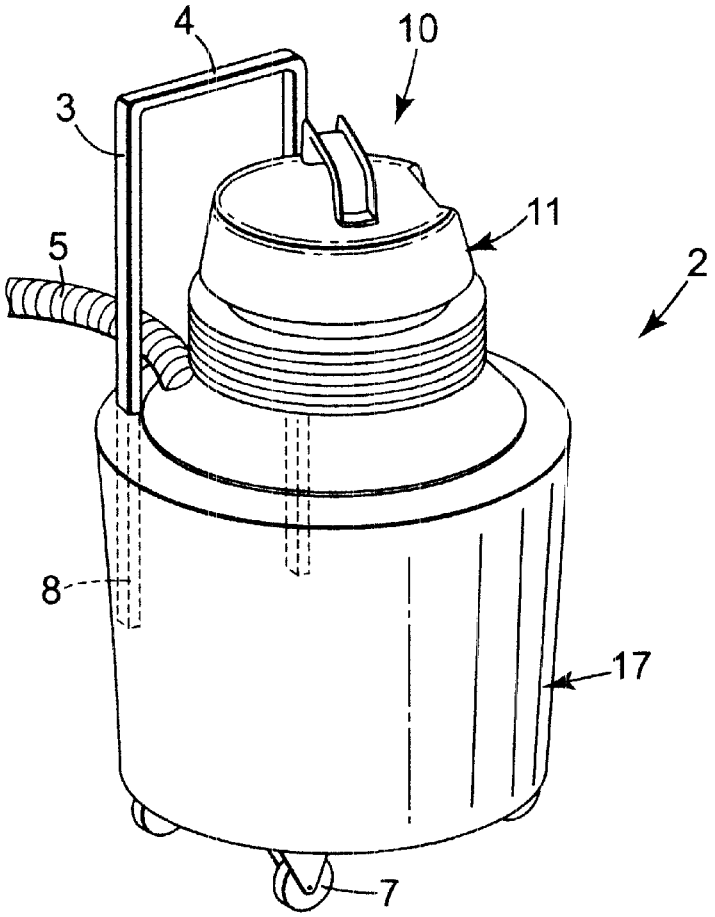
FIG. 6 shows a vertically oriented canister type vacuum cleaning appliance, in accordance with the invention, with a telescoping handle in the extended position and the flexible hose attaching to the top portion of the housing at a distance less than half the diameter of the generally cylindrical housing unit from where said handle attaches to said bottom portion of said housing unit when viewed from above.

The channel 8, or channels, of the telescoping handle 3 can be mounted on the exterior surface of the housing unit, or the interior surface of the housing unit. When the channel 8, or channels, is mounted on the interior surface of the housing unit 2 openings in the housing unit 2 are provided, one per channel, to allow the handle 3 to pass through the surface of the housing unit 2. For hinged type handles 3 the hinges 18 are attached to the exterior surface of the housing unit 2, as shown in FIG. 6.

With this invention thus explained, it should be understood that numerous modifications and variations can be made without departing form the scope of this invention as disclosed and claimed herein.

What is claimed is:

1. A vacuum cleaning appliance operated by an electric motor, comprising: a horizontally oriented housing unit with front and back end portions, said housing unit containing the electric motor, an air impeller, and a dirt collecting reservoir; a flexible hose assembly with distal and proximal ends, said distal end of the hose assembly adapted to be releasably attached to said front end portion of said housing unit, said proximal end of said flexible hose adapted to releasably engage various cleaning attachments; front and back transport wheels attached to said housing unit to allow said housing unit to be easily moved; a collapsible handle with distal and proximal ends, said distal end being attached to said housing unit adjacent said front end portion of said housing unit; a hand grip attached to said proximal end of said collapsible handle, wherein said collapsible handle has an extended use position and a collapsed storage position, and wherein said collapsible handle extends outwardly from said front end portion of the housing in the direction of the main axis of the housing unit wherein the extended position of said collapsible handle positions said hand grip at a height of about 20 to 36 inches when said front end portion of the housing unit is lifted such that the weight of the housing unit is on the back wheels and the angle of the main axis of the housing unit and the supporting surface is between about 30 and 80 degrees.

2. A vacuum cleaning appliance operated by an electric motor, comprising: a horizontally oriented housing unit with front and back end portions, said housing unit containing the electric motor, an air impeller, and a dirt collecting reservoir; a flexible hose assembly with distal and proximal ends, said distal end of the hose assembly adapted to be releasably attached to said front end portion of said housing unit, said proximal end of said flexible hose adapted to releasably engage various cleaning attachments; front and back transport wheels attached to said housing unit to allow said housing unit to be easily moved; a collapsible handle with distal and proximal ends, said distal end being attached to said housing unit adjacent said front end portion of said housing unit; a hand grip attached to said proximal end of said collapsible handle, wherein said collapsible handle has an extended use position and a collapsed storage position, and wherein said collapsible handle extends outwardly from said front end portion of the housing in the direction of the main axis of the housing unit wherein said collapsible handle is a telescoping type handle.

3. A vacuum cleaning appliance of claim 2 wherein at least one handle guiding and storage channel is attached to the exterior surface of the housing unit.

4. A vacuum cleaning appliance of claim 2 wherein at least one handle guiding and storage channel is contained within the housing unit.

5. A vacuum cleaning appliance of claim 2 wherein said telescoping type handle has two telescoping shafts.

6. A vacuum cleaning appliance of claim 2 wherein said handle extends at least about 12 inches beyond the front edge of the front portion of said housing unit when said handle is in the extended position.

7. A vacuum cleaning appliance operated by an electric motor, comprising: a horizontally oriented housing unit with front and back end portions, said housing unit containing the electric motor, an air impeller, and a dirt collecting reservoir; a flexible hose assembly with distal and proximal ends, said distal end of the hose assembly adapted to be releasably attached to said front end portion of said housing unit, said proximal end of said flexible hose adapted to releasably engage various cleaning attachments; front and back transport wheels attached to said housing unit to allow said housing unit to be easily moved; a collapsible handle with distal and proximal ends, said distal end being attached to said housing unit adjacent said front end portion of said housing unit; a hand grip attached to said proximal end of said collapsible handle, wherein said collapsible handle has an extended use position and a collapsed storage position, and wherein said collapsible handle extends outwardly from said front end portion of the housing unit at an upward angle of between about 35 and 75 degrees relative to the main axis of said housing unit.

8. A vacuum cleaning appliance of claim 7 wherein the extended position of said collapsible handle positions said hand grip at a height of about 20 to 36 inches such that movement of said housing unit can be achieved using the handgrip of said handle without lifting the front end portion of said housing unit.

9. A vacuum cleaning appliance of claim 7 wherein said distal end of said collapsible handle is attached in a hinged manner to the housing unit adjacent the front end portion of the housing unit such that in the collapsed position the handle lies adjacent the surface of the housing unit.

10. A vacuum cleaning appliance of claim 7 wherein said handle is a telescoping type handle.

11. A vacuum cleaning appliance of claim 7 wherein said handle is a telescoping type handle and wherein at least one handle guiding and storage channel is attached to the exterior surface of the housing unit.

12. A vacuum cleaning appliance of claim 7 wherein said handle is a telescoping type handle and wherein at least one handle guiding and storage channel is contained within the housing unit.

13. A vacuum cleaning appliance of claim 7 wherein said handle is a telescoping type handle wherein there are two telescoping shafts.

14. A vacuum cleaning appliance of claim 9 wherein said hinged handle has two shafts.

15. A vacuum cleaning appliance operated by an electric motor, comprising: a vertically oriented housing unit with top and bottom portions, said top portion of the housing unit containing the electric motor and an air impeller; a flexible hose assembly with distal and proximal ends, said distal end of the hose assembly adapted to be releasably attached to said housing unit, said proximal end of said flexible hose adapted to releasably engage various cleaning attachments; transport wheels attached to said bottom portion of said housing unit to allow said housing to be easily moved; a collapsible handle with distal and proximal ends, said distal end being attached to said bottom portion of the housing unit; a hand grip attached to said proximal end of said collapsible handle, said collapsible handle having a generally vertical extended use position and a collapsed storage position, and wherein said distal end of said flexible hose assembly attaches to said bottom portion of said housing unit and wherein said distal end of said handle is attached to said bottom portion of said housing unit adjacent the attachment of said hose to said bottom portion of the housing unit.

16. A vacuum cleaning appliance of claim 15 wherein said handle is of the telescoping type.

17. A vacuum cleaning appliance of claim 15 wherein said telescoping handle has at least one shaft.

18. A vacuum cleaning appliance of claim 15 wherein said handle attaches to the outer surface of said bottom portion of said housing unit.

19. A vacuum cleaning appliance of claim 15 wherein said handgrip is at a height of between about 20 and about 36 inches when said handle is in an extended position.

20. A vacuum cleaning appliance of claim 15 wherein said handgrip is at a height of between about 20 and about 36 inches when said handle is in an extended position, and when said vertically oriented housing unit is tilted at an angle of about 30 to about 80 degrees relative to the support surface.

21. A vacuum cleaning appliance operated by an electric motor, comprising a horizontally oriented housing unit with front and back end portions, said housing unit containing the electric motor, an air impeller, and a dirt collecting reservoir; a flexible hose assembly with distal and proximal ends, said distal end of the hose assembly adapted to be releasably attached to said front end portion of said housing unit, said proximal end of said flexible hose adapted to releasably engage various cleaning attachments; front and back transport wheels attached to said housing unit to allow said housing unit to be easily moved; a collapsible handle with distal and proximal ends, said distal end being attached to said housing unit in a hinged manner adjacent said front end portion of said housing unit; a hand grip attached to said proximal end of said collapsible handle, wherein said collapsible handle has an extended use position and a collapsed storage position, and wherein said collapsible handle extends outwardly from said front end portion of the housing generally in the direction of the main axis of the housing unit wherein the extended position of said collapsible handle positions said hand grip at a height of about 20 to 36 inches when said front end portion of the housing unit is lifted such that the weight of the housing unit is on the back wheels and the angle of the main axis of the housing unit and the supporting surface is between about 30 and 80 degrees, and wherein collapsible handle is of the telescoping type, and wherein said collapsed position of said handle positions the handle adjacent the surface of the housing unit.

22. A vacuum cleaning appliance operated by an electric motor, comprising: a horizontally oriented housing unit with front and back end portions, said housing unit containing the electric motor, an air impeller, and a dirt collecting reservoir; a flexible hose assembly with distal and proximal ends, said distal end of the hose assembly adapted to be releasably attached to said front end portion of said housing unit, said proximal end of said flexible hose adapted to releasably engage various cleaning attachments; front and back transport wheels attached to said housing unit to allow said housing unit to be easily moved; a collapsible handle with distal and proximal ends, said distal end being attached to said housing unit in a hinged manner adjacent said front end portion of said housing unit; a hand grip attached to said proximal end of said collapsible handle, wherein said collapsible handle has an extended use position and a collapsed storage position, and wherein said collapsible handle extends outwardly from said front end portion of the housing generally in the direction of the main axis of the housing unit wherein the extended position of said collapsible handle positions said hand grip at a height of about 20 to 36 inches when said front end portion of the housing unit is lifted such that the weight of the housing unit is on the back wheels and the angle of the main axis of the housing unit and the supporting surface is between about 30 and 80 degrees, and wherein said distal end of said collapsible handle is attached in a hinged manner to the housing unit adjacent the front end portion of the housing unit such that in the collapsed position the handle lies adjacent the surface of the housing unit.

23. A vacuum cleaning appliance operated by an electric motor, comprising: a generally cylindrically shaped vertically oriented housing unit with top and bottom portions, said top portion of the housing unit containing the electric motor and an air impeller; a flexible hose assembly with distal and proximal ends, said distal end of said flexible hose assembly adapted to releasably attached to said top portion of said housing unit, said proximal end of said flexible hose adapted to releasably engage various cleaning attachments; transport wheels attached to said bottom portion of said housing unit to allow said housing unit to be easily moved; a collapsible handle with distal and proximal ends, said distal end being attached to said bottom portion of said housing unit; and a hand grip attached to said proximal end of said collapsible handle, wherein said collapsible handle has an extended use position and a collapsed storage position, and wherein said collapsible handle has a generally vertical extended use position, wherein said distal end of said flexible hose assembly attaches to said top portion of said housing unit at a distance less than half the diameter of the generally cylindrical housing unit from where said handle attaches to said bottom portion of said housing unit when viewed from above.

24. A vacuum cleaning appliance of claim 23 wherein said handle is of the telescoping type.

25. A vacuum cleaning appliance of claim 24 wherein said telescoping handle has at least one shaft.

26. A vacuum cleaning appliance of claim 23 wherein said handle attaches to the outer surface of said bottom portion of said housing unit.

27. A vacuum cleaning appliance of claim 23 wherein said handgrip is at a height of between about 20 and about 36 inches when said handle is in an extended position.

28. A vacuum cleaning appliance of claim 23 wherein said handgrip is at a height of between about 20 and about 36 inches when said handle is in an extended position, and when said vertically oriented housing unit is tilted at an angle of about 30 to about 80 degrees relative to the support surface.

* * * * *